US006791507B2

(12) United States Patent
Johansson et al.

(10) Patent No.: US 6,791,507 B2
(45) Date of Patent: Sep. 14, 2004

(54) FEED NETWORK FOR SIMULTANEOUS GENERATION OF NARROW AND WIDE BEAMS WITH A ROTATIONAL-SYMMETRIC ANTENNA

(75) Inventors: Martin Johansson, Molndal (SE); Bjorn Johannisson, Kungsbacka (SE); Bo Hagerman, Stockholm (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 10/366,631

(22) Filed: Feb. 13, 2003

(65) Prior Publication Data

US 2004/0160374 A1 Aug. 19, 2004

(51) Int. Cl.[7] ..... H01Q 21/00
(52) U.S. Cl. ..... 343/853; 343/754
(58) Field of Search ..... 343/754, 853, 343/757; 455/561, 562; 342/371, 373, 375

(56) References Cited

U.S. PATENT DOCUMENTS

| | | | | |
|---|---|---|---|---|
| 3,736,592 A | | 5/1973 | Coleman | 343/854 |
| 4,425,567 A | * | 1/1984 | Tresselt | 342/373 |
| 4,446,463 A | * | 5/1984 | Irzinski | 342/371 |
| 4,451,831 A | * | 5/1984 | Stangel et al. | 342/374 |
| 5,086,302 A | * | 2/1992 | Miller | 342/373 |
| 5,179,386 A | | 1/1993 | Rudish et al. | 342/371 |
| 6,057,806 A | | 5/2000 | Lopez | 343/890 |
| 6,549,171 B1 | * | 4/2003 | Mailloux | 343/754 |
| 2002/0113743 A1 | | 8/2002 | Judd et al. | 343/757 |

FOREIGN PATENT DOCUMENTS

WO 02/01673 1/2002

OTHER PUBLICATIONS

Sheleg, Boris; A Matrix–Fed Circular Array for Continuous Scanning, Proceedings of the IEEE, vol. 56, No. 11, Nov. 1968, pp. 2016–2027.

* cited by examiner

*Primary Examiner*—Hoang V. Nguyen
(74) *Attorney, Agent, or Firm*—Jackson Walker, L.L.P.; Robert C. Klinger

(57) ABSTRACT

An N-element rotational-symmetric array antenna can generate N fixed pencil-beams simultaneously with an omnidirectional beam. An N×N Butler matrix can be used to feed the array antenna, using fewer than N input ports of the Butler matrix to produce the pencil-beams. One or more of the modes generated by the Butler matrix can be individually accessed to produce one or more corresponding omnidirectional beams. The N×N Butler matrix can be driven by a feed network that provides both power dividing and beam-steering, which permits simultaneous generation of the N pencil-beams.

45 Claims, 8 Drawing Sheets

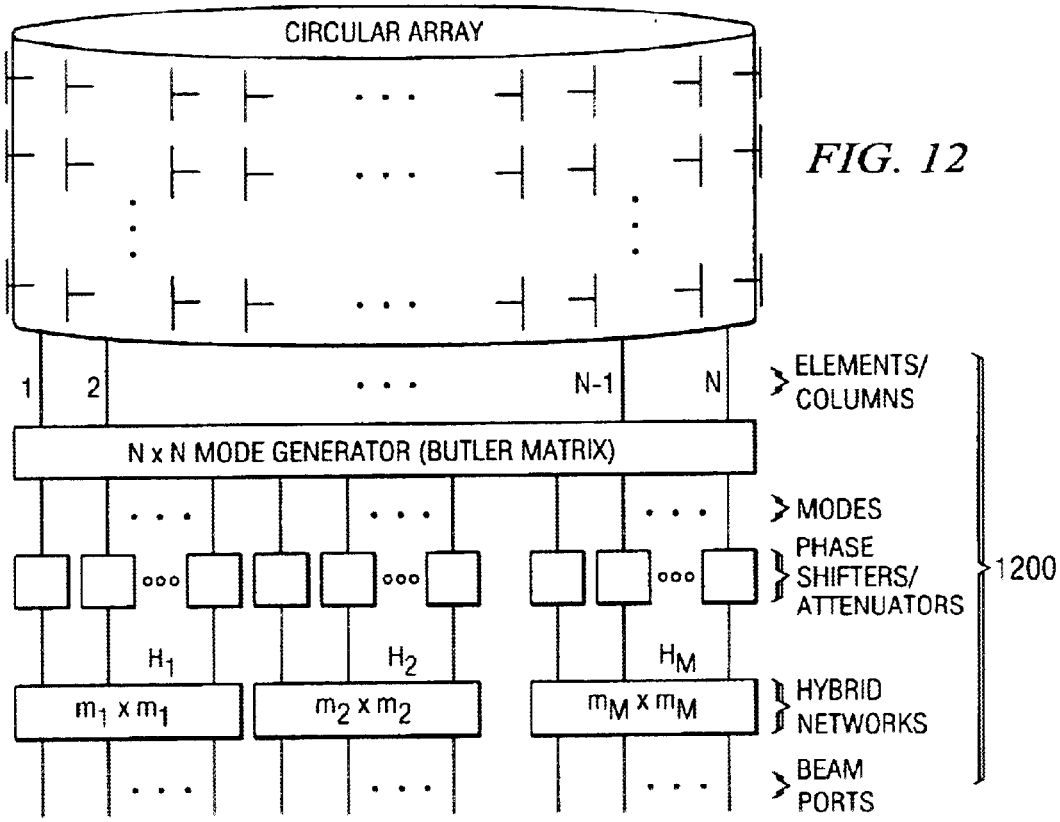
FIG. 12
FIG. 14
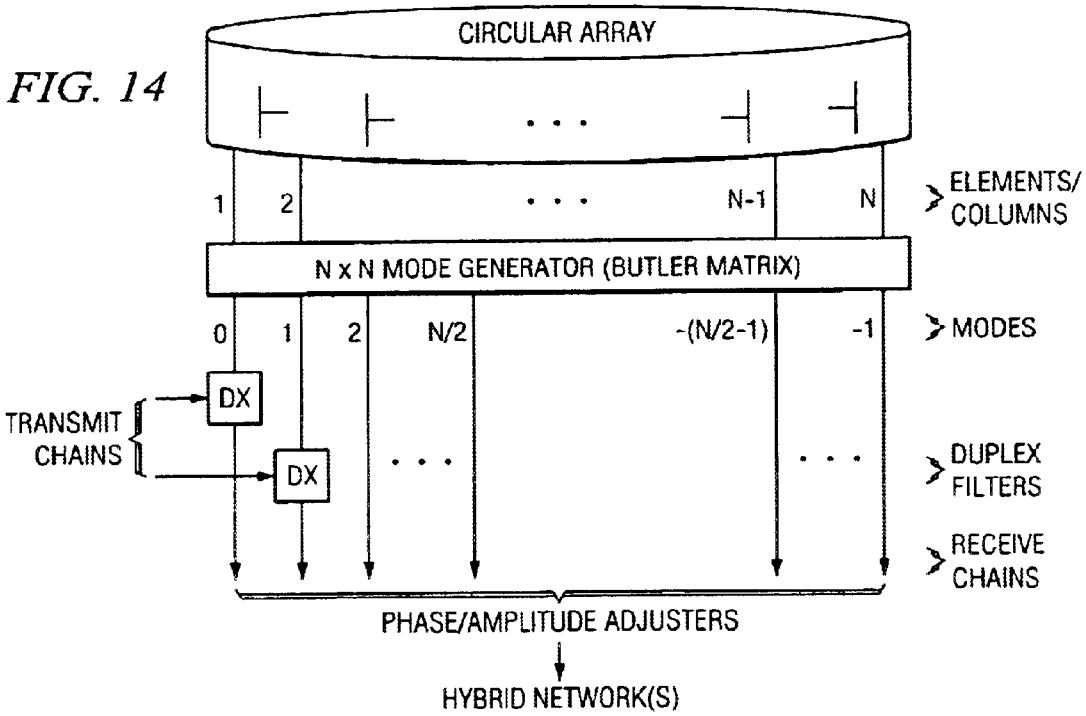

FEED NETWORK FOR SIMULTANEOUS GENERATION OF NARROW AND WIDE BEAMS WITH A ROTATIONAL-SYMMETRIC ANTENNA

FIELD OF THE INVENTION

The invention relates generally to wireless communications and, more particularly, to a feed network for simultaneous transmission of narrow and wide beams from a cylindrical antenna.

BACKGROUND OF THE INVENTION

As mobile communications, such as wideband code division multiple access ("WCDMA") and global system for mobile communications ("GSM"), proliferate, the number of antennas required to provide communications coverage increases. For a variety of reasons, it may be preferable to make these antennas "conformal" to some existing structure. For example, it may be aesthetically preferable or functionally necessary to unobtrusively mount a base station antenna on the wall of a building. Or, for aerodynamic reasons, an antenna mounted on an airplane would need to conform to the contours of the airplane. Conformal or, more generally, "non-planar" array antennas offer the potential of an integrated, non-obtrusive solution for multibeam antenna applications. Two (2) basic "conformal" antenna geometries used for this are the circular-cylindrical and spherical array antennas.

The use of array antennas in mobile communications base stations has been shown to facilitate increased network capacity due to the creation of narrow (pencil or directional) beams that reduce interference levels. Narrow beams provide a "spatial filter" function, which reduces interference on both downlink and uplink. On downlink (i.e., from base station to mobile device), a narrow beam reduces the interference experienced by mobile devices not communicating via the beam in question. On uplink, a narrow beam reduces the interference experienced by the base station for communication links using the beam in question.

Vertically installed implementations of rotational-symmetric array antennas can offer omnidirectional coverage in the horizontal plane by the use of multiple beams. The beams are typically formed using the radiation from more than one (1) element (or vertical column) along the circumference of the array (i.e., the horizontal radiation pattern is an array pattern). For fixed-beam antennas, the individual elements (or columns) will be connected, via a feed network, to a number of beam ports. Each beam port generates the element excitation of one or (typically) more columns. An omnidirectional antenna can produce an omnidirectional pattern having essentially identical gain/directivity in all directions in a plane simultaneously. If a beam covers all 360° in a given plane simultaneously, it is omnidirectional in that plane and there is no need to steer the beam. Omnidirectional coverage enables a communications link that is independent of the direction from the base station to the mobile unit. An omnidirectional pattern provides omnidirectional coverage at all times, whereas a pencil-beam (narrow beam) antenna with steered (or fixed) beams can provide omnidirectional coverage by directing (or selecting in the case of fixed beams) a beam in a desired direction. A steered (or selected) beam will only cover a portion of the desired angular interval at a given instant in time.

Although the generation of simultaneous pencil- and sector-covering beams is trivially achieved in the planar array case by placing a sector antenna next to an array antenna, a similar arrangement is not possible for a circular array. An extra sector antenna (i.e., an omnidirectional antenna) would have to be placed above or below the circular array in order to avoid interference with the array beams.

A number of feed networks exist which provide some, but not all, of the aforementioned capabilities. Although theoretically lossless and feeding all elements in parallel, an N×N Butler matrix will generate N rotational-symmetric patterns, but without the pencil-beam shape. A Blass matrix is similar to a Butler matrix in that they both depend on directional couplers to achieve a desired distribution of power through the feed network. Although a Blass matrix can be used to generate pencil-beams, it cannot provide N identical beams due to the discontinuity of the element excitations when the network is used to feed a circular array.

Another class of feed networks is lenses. Lenses can be made to produce pencil-beams, but they suffer from loss due to non-orthogonality of the beam ports. Even if orthogonality can be achieved, lenses for omnidirectional coverage are typically unwieldy and expensive to manufacture, particularly as compared to transmission-line feed networks.

Therefore, no viable antenna feed network presently exists that can enable a rotational-symmetric array antenna to: (1) generate N identical fixed pencil-beams simultaneously, (2) generate each pencil beam using respectively corresponding antenna elements that are circumferentially separated from one another; and (3) generate an omnidirectional beam simultaneously with the pencil beams using the same antenna elements.

It is therefore desirable to provide a practical feed network that enables an N-element rotational-symmetric array antenna to generate N identical fixed pencil-beams simultaneously with an omnidirectional beam. In some embodiments, the present invention provides N identical fixed pencil-beams using fewer than N input ports of an N×N Butler matrix that feeds an N-element rotational-symmetric array antenna, and simultaneously provides an omnidirectional beam by individually accessing one of the modes generated by the Butler matrix. The N×N Butler matrix that feeds the array antenna can be driven by a feed network that applies both power division and beam-steering to a plurality of input beam signals, thereby permitting generation of N pencil-beams simultaneously.

BRIEF DESCRIPTION OF THE DRAWINGS

The above and further advantages of the invention may be better understood by referring to the following description in conjunction with the accompanying drawings in which corresponding numerals in the different figures refer to the corresponding parts, in which:

FIG. 12 diagrammatically illustrates further exemplary embodiments of an antenna apparatus according to the present invention;

FIG. 14 diagrammatically illustrates further exemplary embodiments of an antenna apparatus according to the present invention.

DETAILED DESCRIPTION

While the making and using of various embodiments of the present invention are discussed herein in terms of specific feed network configurations and matrices, it should be appreciated that the present invention provides many inventive concepts that can be embodied in a wide variety of contexts. The specific embodiments discussed herein are merely illustrative of specific ways to make and use the invention, and arc not meant to limit the scope of the invention.

The present invention provides a practical feed network that enables a rotational-symmetric array antenna to generate N fixed pencil-beams and simultaneous pencil- and omni-beams. The present invention can accomplish this by using fewer than N input ports of an N×N Butler matrix to feed an N-element (or N-column) rotational-symmetric (e.g., circular) array antenna and by individually accessing the modes generated by the Butler matrix. Beam number n of the present invention can point in the direction:

$$\phi_n=\phi_0+2\pi n/N,$$

where n=1 . . . N and $\phi_0$ is a constant offset angle. Additionally, the present invention can use more than one (1) element (or column) along the circumference of the array to generate each beam, thereby increasing the azimuthal gain and facilitating the shaping of the azimuthal pattern. An "array column" should be interpreted as a set of "elements" oriented in the same azimuthal (e.g., horizontal) direction. The direction and corresponding plane of the array antenna's rotational axis (e.g., vertical) is orthogonal to the array antenna's azimuthal directions and corresponding plane (horizontal for a vertical rotational axis). Using the vertical/horizontal example, as long as the vertical amplitude and phase distribution is the same for all columns, the phase and amplitude distribution in the vertical direction is independent of the phase and amplitude distribution in the horizontal plane (azimuthally around the array antenna).

As will be clear from the description, the present invention is generally applicable to any rotationally symmetric array antenna having a plurality of circumferentially spaced array antenna elements, where each array antenna element can include one or a plurality of antenna elements.

Figure 1:
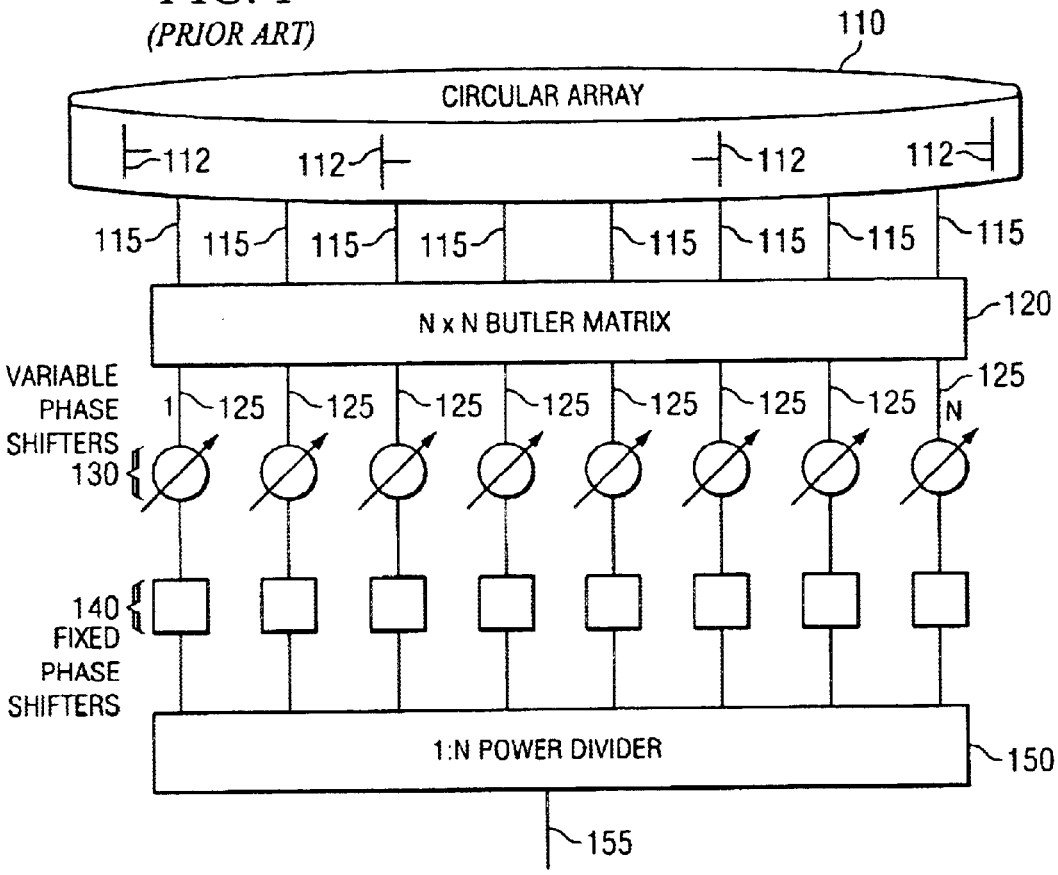
FIG. 1 (PRIOR ART)
FIG. 1 diagrammatically illustrates a single-beam phase-steered circular array antenna with a Butler matrix mode-generator in accordance with the known art.

FIG. 1 shows a prior art example of a feed network including a single-beam phase-steered circular array antenna 110 with a Butler matrix 120 mode-generator. Power divider 150 performs an amplitude weighting of the modes that will be generated by Butler matrix 120. The power does not necessarily have to be divided equally over input ports 125 of Butler matrix 120. Power divider input port 155 represents a beam port. After passing through fixed phase shifters 140 and variable phase shifters 130, the output of power divider 150, input via input port 155, will be distributed over input ports 125, after which the signal will be combined by Butler matrix 120 to get the excitation of each element column 112. An N×N Butler matrix 120 feeding a circular array 110 will produce N sets of uniform amplitude excitations of output ports 115, each excitation having a progressive phase shift, the size of which depends on the feed port 125 of Butler matrix 120. For Butler matrix 120 with phase shifts from the first element column 112 to the (non-existent) $(N+1)^{th}$ element column 112 being integer multiples of 360°, the N excitations (and corresponding radiation patterns) can be considered to be modes, since they are orthogonal under a summation (or integration) around the array. Thus, each input port 125 generates a single mode.

These modes can be individually controlled, with respect to both amplitude and phase, to produce radiation patterns with desired characteristics. In particular, the application of a progressive linear phase shift on the signal entering Butler matrix 120 can enable steering of the resulting beam. Therefore, the beam can be steered in any azimuthal direction around the array with little variation in the beam shape as it moves from one element direction to the next. The result is a circular-array that is equivalent to a phase-steered uniform linear array. However, it still does not explicitly produce omnidirectional beams or multiple simultaneous beams.

The movement of the steered beam of FIG. 1 as realized by variable phase shifters 130 and fixed phase shifters 140 is limited to the plane orthogonal to the axis of circular-cylindric array 110. Assuming that this axis is along the vertical axis (i.e., array elements 112 as shown in FIG. 1 are in a common horizontal plane), the steering is limited to the horizontal plane. A general circular-cylindric array antenna can also be steered along its axis (i.e., in the vertical direction), but this requires additional feed networks dedicated to vertical beam-steering, also known at beam-tilting. A general circular-cylindric array antenna can also generate shaped beam patterns in the elevation direction, for example cosecant-squared patterns.

Figure 2A:
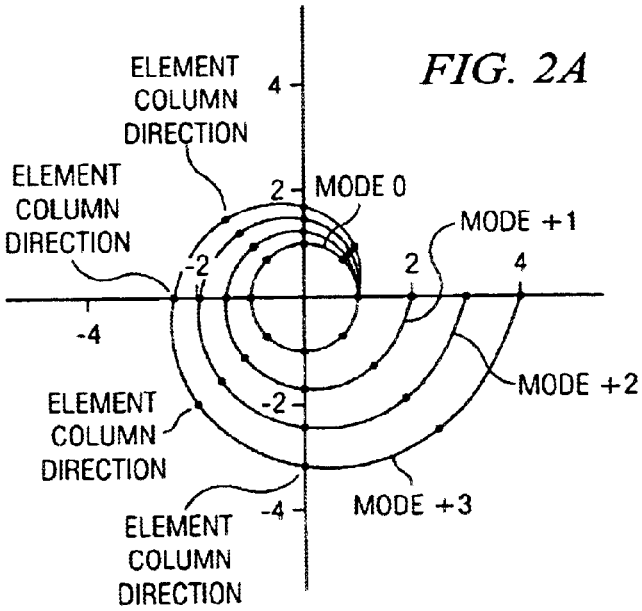
FIGS. 2A and 2B illustrate phase values normalized to $2\pi$ for each element excitation generated by an 8×8 Butler matrix in accordance with the known art.
Figure 2B:
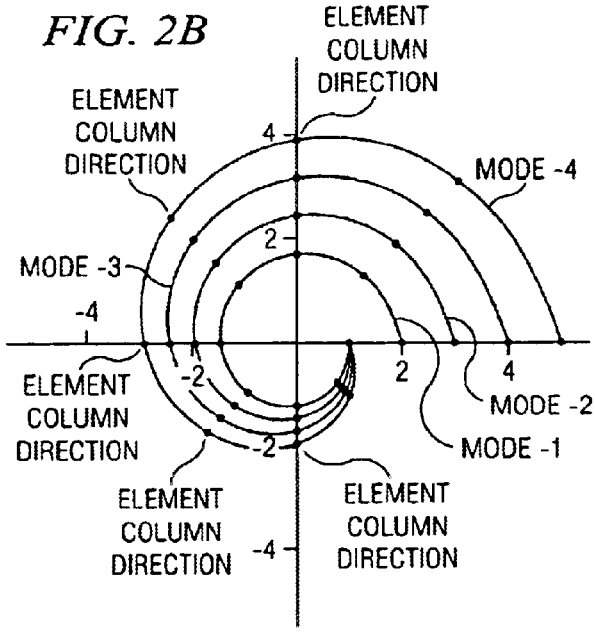

The element column 112 phase values for each of the aforementioned modes can be plotted. The resultant pattern is shown in FIGS. 2A and 2B which illustrate phase values normalized to 2π for each element column excitation generated by an 8×8 Butler matrix. The phase values are illustrated by radial distance from the origins in FIGS. 2A and 2B. FIG. 2A shows values for modes 0, +1, +2, and +3. FIG. 2B shows values for modes −1, −2, −3, and −4. The phase reference value in FIGS. 2A and 2B has been arbitrarily chosen to be 1 (one) for purposes of discussion. The phase values for the element columns are indicated by the dots. The lines connecting the dots indicate that the connected dots belong to the same mode. The phase values spiral around the antenna, each mode having a different spiral slope because the derivative of the phase in the azimuthal direction at a constant radius is different for each mode. The nth element column 112 is positioned on a circle at azimuthal angle $\phi=(n-1)\pi/4$. Mode 0 has no phase change. Therefore, all the dots on the circle for mode 0 are at a radius equal to 1 (one). Higher order modes have a linear phase increase from element to element. Additionally, mode +4 is the same mode as mode −4. This is because the phase change from element column 112 to (adjacent) element column 112 is $\pi$ ((or $-\pi$), as discussed in more detail below. Therefore, mode 4 can be defined with either sign.

The choice of Butler matrix 120 can enable the mode corresponding to input port 1 of Butler matrix 120 to have zero phase on all output ports 115 and corresponding array elements 112. The second mode has a phase change of $2\pi$ for each cycle around the axis of rotation, starting at a first element column 112, moving through all elements 112 and returning to the first element column 112 (i.e., for an angular movement of $2\pi$ around the antenna). Mode 3 has a phase change of $4\pi$, and so on in geometric progression. For N×N Butler matrix 120, modes of order N/2 and greater have a phase from the nth element column 112 to the $(n+1)^{th}$ element column 112 which is equal to or greater than $\pi$. For example, for N=8, mode N/2 is mode 4 and the phase change for mode 4 is $8\pi$. Therefore, these modes are considered as having negative index values, since $\Delta\phi$ and $\Delta\phi-2\pi$ are identical from a phase point-of-view, although the latter has a smaller absolute value for $\Delta\phi>\pi$. Mode N/2, which only exists if N is even, can have any sign (i.e., positive or negative) since the phase change is $\pi$(or $-\pi$) from element column 112 to (adjacent) element column 112.

Figure 3:
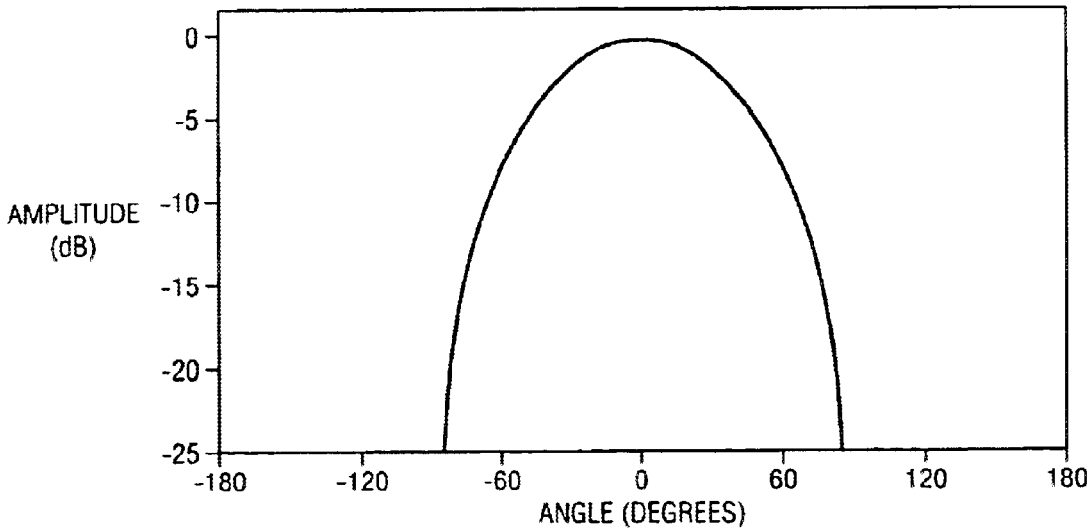
FIG. 3 illustrates an element pattern modeled on the radiation pattern for a patch antenna over an infinite ground plane in accordance with the known art.

For illustrative purposes of this discussion, a theoretical element pattern has been chosen for use in the radiation pattern calculations. FIG. 3 illustrates an exemplary element pattern modeled on the radiation pattern for a patch antenna over an infinite ground plane in accordance with the known art. Therefore, there is no radiation in the backward direction. This is the element pattern used for purposes of this discussion.

Figure 4:
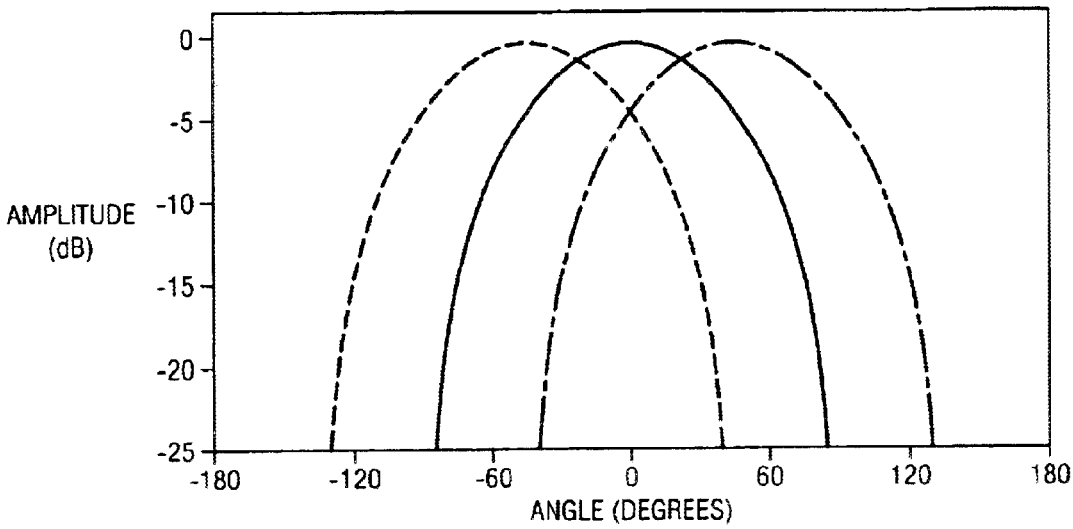
FIG. 4 illustrates a resulting radiation pattern from an eight-element circular array antenna fed by an 8×8 Butler matrix in accordance with the known art.

Turning again to FIG. 1, N can be set to 8, fixed phase shifters 140 can have zero (0) phase and all modes 1 through N can have the same amplitude (which is unnecessary but enables simplification of this discussion). A linear phase $\psi_m$ can be applied (e.g., by variable phase shifters 130) over input ports 125, using $\psi_m=(m-1)\Delta\phi$ where the phase setting $\Delta\phi$ can take any value. FIG. 4 illustrates a resulting radiation pattern for phase settings of $-1/\pi4$, 0 and $\pi/4$ when all input ports 125 of Butler matrix 120 are fed with identical amplitude. Since only one (1) output port 115 of Butler matrix 120 gets excited for each choice of phase front (because the chosen phase fronts correspond to phase distributions produced by the Butler matrix when respective ones of its input ports are fed alone), the resulting patterns are all identical to the element pattern used (FIG. 3). Similar patterns can be achieved for phase settings not corresponding exactly to the phase values of Butler matrix 120. The pattern shapes will vary slightly with $\Delta\phi$ due to the influence of the element pattern (FIG. 3).

Figure 5:
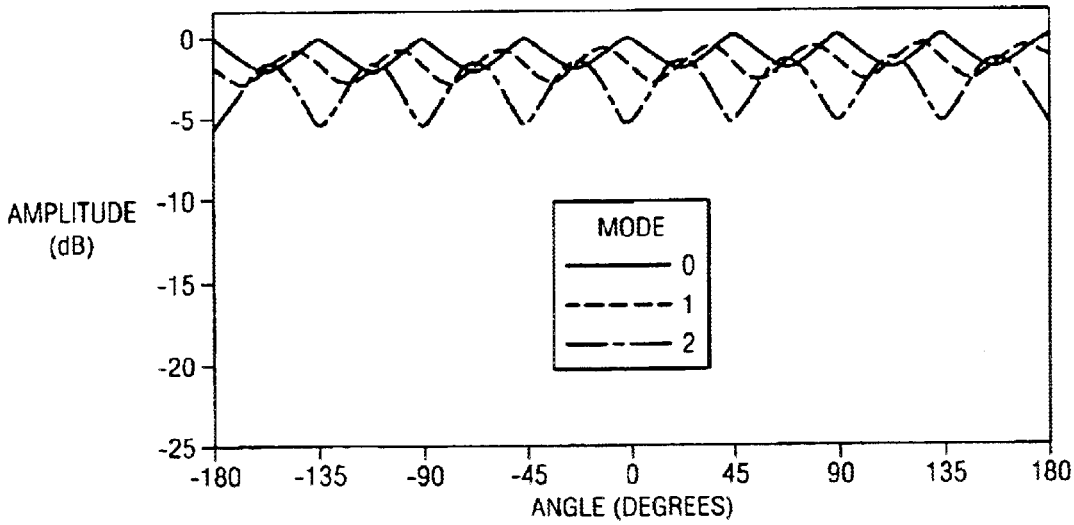
FIG. 5 illustrates resulting radiation patterns for modes 0, (+)1, and (+)2 from feeding only one of the input ports of a Butler matrix in accordance with the known art.
Figure 6:
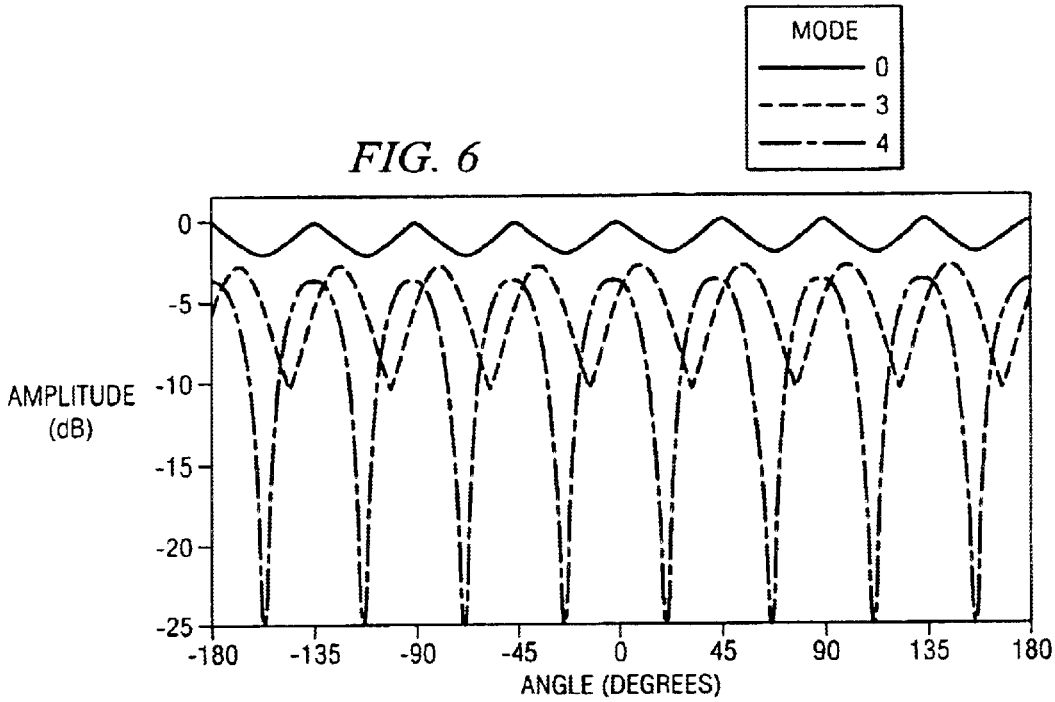
FIG. 6 illustrates resulting radiation patterns for modes 0, (+)3, and (+)4 from feeding only one of the input ports of a Butler matrix in accordance with the known art.

As known in the art, feeding only one of input ports 125 of Butler matrix 120 can produce an element excitation ("mode" excitation) with uniform amplitude and linear phase around the circumference of array 110. FIG. 5 illustrates resulting radiation patterns for modes 0 (shown beginning at approximately 0 dB), (+)1 dashed pattern), and (+)2 (shown beginning at approximately−5 dB) from feeding only one of input ports 125 of Butler matrix 120 per mode. FIG. 6 illustrates resulting radiation patterns for modes 0 (shown beginning at approximately 0 dB), (+)3 (dashed pattern), and (+)4 (pattern with greatest amplitude variation) from feeding only one of input ports 125 of Butler matrix 120.

It can be seen in FIGS. 5 and 6 that the amplitude ripple increases with increasing mode number. For the highest order mode (mode 4, shown in FIG. 6), there are fully developed nulldepths (which appear regardless of the radius of array 110) because the excitation phase shift from element to element is $\pi$. The amplitude ripple will depend on both the mode number (i.e., excitation phase) and the element pattern (in this case, FIG. 3). The geometry and dimensions of the array antenna can also affect the ripple. Modes with negative and positive mode number have identical radiation patterns, except for a $\pi/8$ radian rotation for odd-numbered modes. Therefore, only patterns for positive modes need be shown. It can be seen from FIG. 5 that the amplitude ripple for modes 0 and 1 is only about +/−1 dB. Therefore, if these modes can be accessed individually, they can be used to generate beams for cellwide transmission and reception that are sufficiently omnidirectional.

Figure 11:
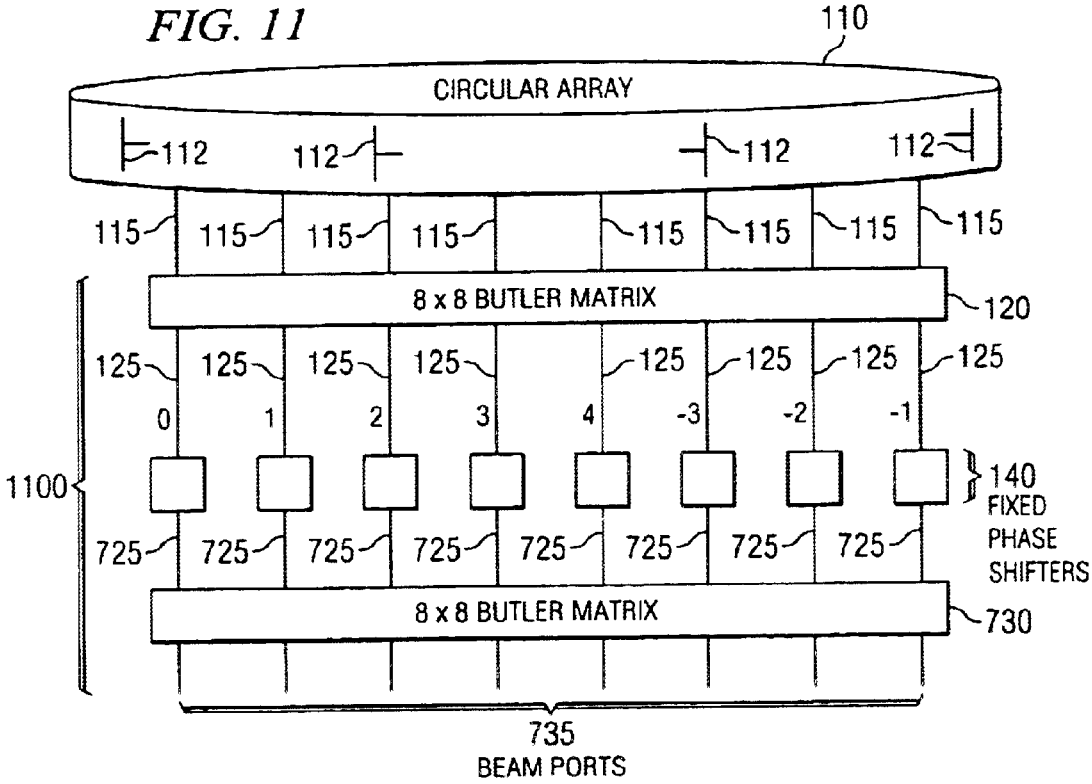
FIG. 11 is similar to FIG. 7, but uses N Butler matrix input ports to produce N pencil-beams.

FIG. 11 illustrates an antenna apparatus in accordance with exemplary embodiments of the present invention. The array 110 can be any antenna array configuration with discrete-angle rotational symmetry. In this embodiment, N simultaneous, approximately identical and equi-spaced fixed pencil-beams are generated by using the N input ports 125 of N×N Butler matrix 120. Butler matrix 120 could be replaced by any network capable of generating element column excitations with approximately uniform amplitude over all element columns 112 and a progressive linear phase change from element column to element column (see also FIGS. 2A and 2B).

Each element column 112 can be representative of an arbitrary number of elements, all located at the same azimuthal angle. For example, each element column 112 could be representative of ten (10) elements, with a separation of 0.9 wavelengths in the vertical direction. Array 110, with N=8, would then have eighty (80) total elements 8×10=80), since each clement column 112 would then consist of a linear array of ten (10) elements. Elements in each element column 112 do not have to reside along a line; but they share a common azimuthal angle.

Butler matrix 730 functions as a power divider, and permits generation of N beams simultaneously. Butler matrix 730 approximately evenly divides the power input via input ports 735 over output ports 725 and produces a progressive phase shift over output ports 725 (the value of the phase shift depending on which input port 735 is fed). Therefore, Butler matrix 730 provides both power division and beam-steering. The input ports 735 can be respectively fed with conventionally produced, mutually independent beam signals. For example, each beam signal could be intended for one or more users associated with a corresponding azimuthal direction, that is one of the radial directions defined between the rotational axis of the array antenna and the respective array antenna elements around its periphery. Each signal output at 725 thus carries signal (excitation) components corresponding to all of the users. Butler matrix 730 can be replaced by any network suitable for beam-generation using the modes produced by Butler matrix 120. The phase shifts implemented at 140 can be chosen in conventional fashion (e.g., using numerical optimization) to optimize the radiation patterns generated by Butler matrix 120. In some embodiments, the Butler matrices 120 and 730 are approximate inverses of one another, such that, if the phase shifts at 140 are all zero, the Butler matrices 120 and 730 would effectively cancel each other out, so the beam ports at 735 would be (virtually) directly connected to the respective element columns 112. Thus, the phase shifters 140 operate to shape the beams formed by Butler matrix 730. Although fixed phase shifters arc shown at 140 in FIG. 11 (and also in FIGS. 7,7A and 12), these can be replaced by any suitable adjuster. For example, in various embodiments, each adjuster at 140 can perform fixed and/or variable phase and/or amplitude adjustment.

Figure 7:
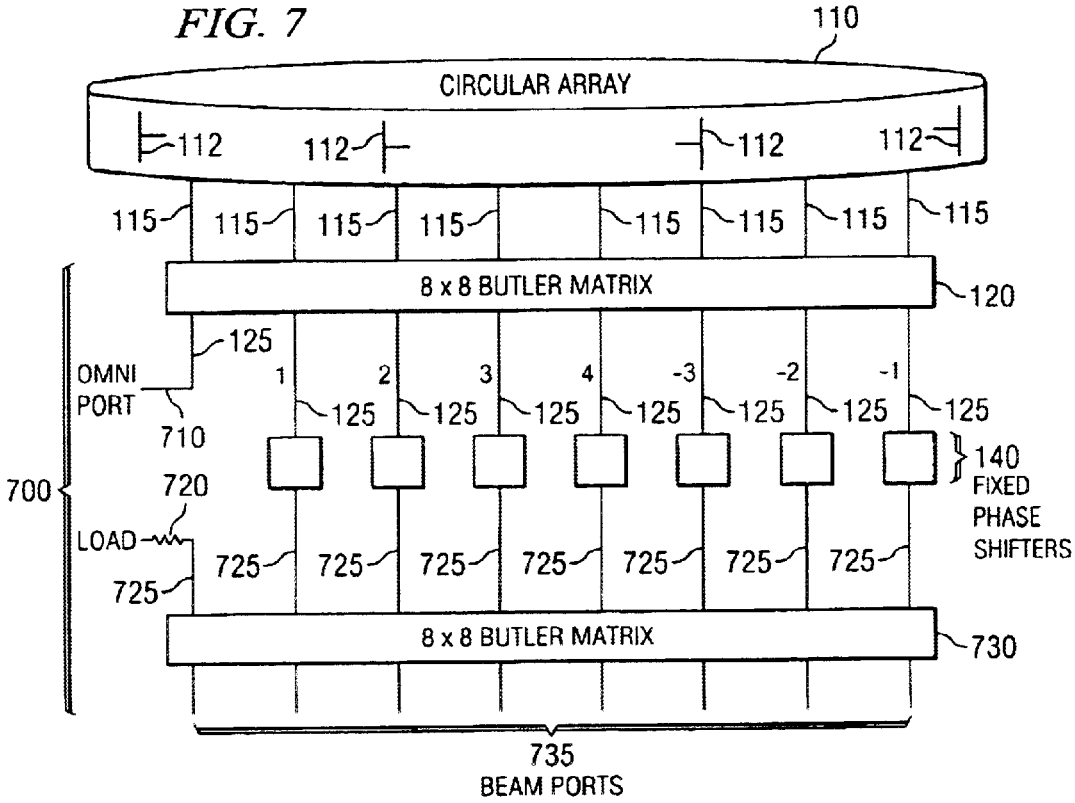
FIG. 7 diagrammatically illustrates exemplary embodiments of an antenna apparatus in accordance with the present invention.

FIG. 7 illustrates exemplary embodiments similar to FIG. 11, but which also provide an omnidirectional beam simultaneously with N pencil-beams. In FIG. 7, omni port 710 (one of input ports 125) of Butler matrix 120 is directly connected to a signal path that carries information to be transmitted omnidirectionally. The remaining input ports 125 are fed from a combination network (in the FIG. 7 example Butler matrix 730), in such a way that array 110 produces as many beams as there are array elements 112 (or columns) around its circumference. Butler matrix 730 has N input ports 735 (in the illustrated embodiments, N=8). The input ports 735 can be respectively fed with conventionally produced, mutually independent beam signals, for example, each beam signal intended for one or more users in a uniquely associated azimuthal direction. Radiation patterns can be calculated for the ports 735 to show how the energy input at ports 735 will be spatially distributed. This produces N beans (i.e., input ports 735 ultimately generate beams that are composed of one or more of the modes generated by Butler matrix 120). These beams will differ from the element pattern (e.g., FIG. 3). The mode at omni port 710 can produce the desired omni-beam.

The number of input ports 125 used to generate the pencil-beams will depend on factors such as the number of element columns 112 and the desired beam quality of the pencil-beams. More element columns 112 result in better azimuthal resolution, thereby permitting more modes to be used for generating omni-beams. (In one example, to obtain a desired beam quality in the case of N=8 element columns, all but one of the modes are required to get acceptable sidelobe levels.) Those input ports 125 that are not used to produce pencil beams can then be individually accessed to generate patterns that are sufficiently omnidirectional.

The one of output ports 725 of Butler matrix 730 that is not connected to Butler matrix 120 can be terminated in load 720. The result is that approximately 1/N of the power in the signals intended for pencil-beams is lost in load 720. If it is desired to maximize power efficiency, then all power from Butler matrix 730 (except the power terminated in load 720) should be transmitted to array 110. In that case, the amplitudes of the different modes cannot be tapered. But, for beam shaping, fixed phase shifters 140 can be used to apply fixed phase shifts to corresponding modes (i.e., 1, 2, 3, 4, −3, −2, and −1 as shown in FIG. 7).

Figure 8:
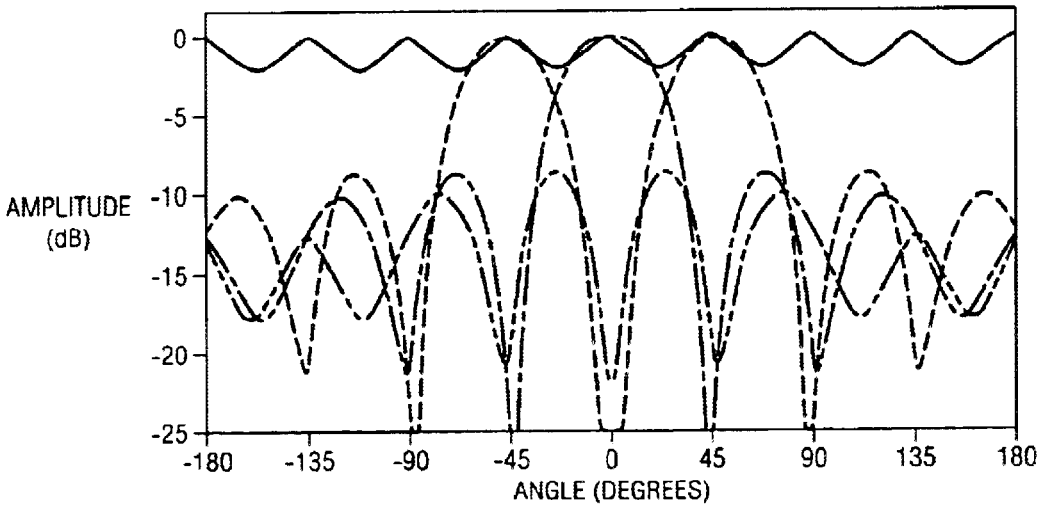
FIG. 8 illustrates resulting radiation patterns for an exemplary embodiment of a Butler matrix-fed circular array antenna in accordance with the present invention.

For example, if the phase shifts of remaining modes 125 are optimized (e.g., using conventional numerical optimization to achieve maximum directivity) with respect to pattern direction, the arrangement of FIG. 7 can produce the exemplary radiation pattern shown in FIG. 8 for the following configuration: antenna radius=0.65 wavelengths, microstrip patch width=0.33 wavelengths and mode weights={1, $e^{j0.8\pi}$, −j,j, −j, , $e^{j0.81\pi}$1} for modes {1, 2,3,4,−3,−2,−1}, respectively. These mode weights respectively correspond to phase values of {0°, 144°, −90°, 90°, −90°, 144°, 0°}. The plot in FIG. 8 shows a pencil-beam radiation pattern (solid) for one of N identical pencil-beams, each corresponding to one of N input ports 735 of Butler matrix 730, for an N=8 element circular array antenna 110 with simultaneous omni-pattern (dashed). The plot in FIG. 8 also shows adjacent pencil-beams patterns (dotted). Adjacent pencil-beams are generated by feeding ports 735 corresponding to pencil-beams to the left and right of the desired beam. They are the two (2) pencil-beams which are closest (in an angular sense) to the pencil-beam in question. The radiation pattern shown in FIG. 8 is more directive than the element pattern (FIG. 3), has a maximum sidelobe level of about 9 dB, a crossover level of 3 dB, and "tracks" the dashed omni-beam pattern.

In can be instructive to think about the "space" in which the element columns reside as an "element space" or "beam space". If we feed one of the columns 112, we get an element pattern (in the azimuthal plane). In the "space" before the first Butler matrix 120, each input port 125 represents a "mode"; feeding one of the input ports 125 results in radiation from all columns 112, i.e., we do not get a pencil-beam, but rather a generally omni-directional pattern, the phase and amplitude variation of which depends on which input port 125 is fed. We can therefore refer to the "space" between Butler matrices 730 and 120 as a "mode space". Anything we do with individual signal paths in this space will affect the corresponding "mode" pattern. Finally, the space before the second Butler matrix 730 (where ports 735 are located) is again a "beam space". For each port 735 we can calculate a radiation pattern showing how energy will be spatially distributed. So, Butler matrix 120 transforms signals from a mode space into abeam (or element) space, and Butler matrix 730 transforms signals from a beam space into the mode space.

Figure 7A:
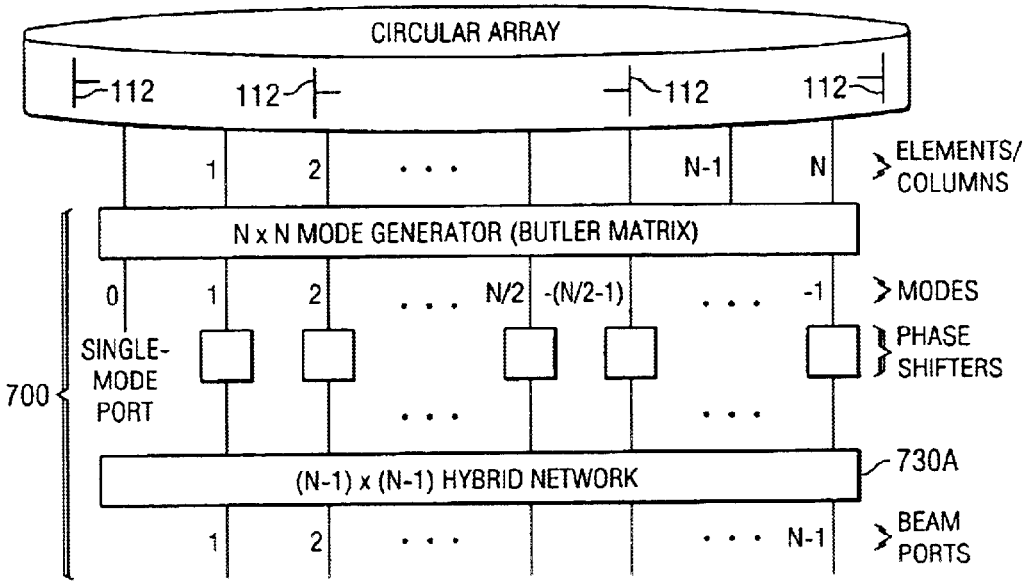
FIG. 7A is similar to FIG. 7, but uses a smaller hybrid network and correspondingly fewer beam ports.

FIG. 7A diagrammatically illustrates exemplary embodiments similar to those of FIG. 7. In FIG. 7A, the N×N Butler matrix 730 of FIG. 7 N=8 in FIG. 7) is replaced by (N−1)×(N−1) hybrid network 730A (for example a Butler matrix). Otherwise, the feed network apparatus 700A of FIG. 7A is generally analogous to the feed network apparatus 700 of FIG. 7. The power lost in the load 720 of FIG. 7 need not be lost in the embodiments of FIG. 7A. The arrangement of FIG. 7A produces a number of pencil-beams that is smaller than the number of array antenna elements in the array antenna.

Figure 13:
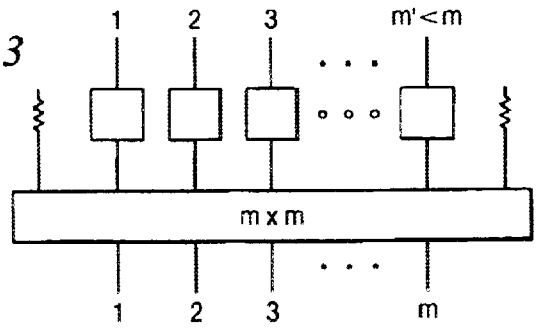
FIG. 13 diagrammatically illustrates exemplary configurations of the hybrid networks of FIG. 12.

FIG. 12 diagrammatically illustrates further exemplary embodiments of an antenna apparatus according to the invention. The feed network apparatus 1200 of FIG. 12 includes a plurality of hybrid networks $H_1$, $H_2$, . . . $H_M$, and selected outputs of the hybrid networks are coupled to respective inputs of the mode-generating Butler matrix. As shown generally in FIG. 13, one or more output ports of, for example, hybrid network $H_2$ can be terminated in loads in order to permit generation of a number of pencil-beams that is greater than the number of array antenna elements in the array antenna. For example, if N=8 in FIG. 12, and if three 4×4 hybrid networks are used, then four of the twelve hybrid network outputs can be terminated in loads, and a total of twelve pencil-beams are generated. A 4×4 hybrid network with two outputs terminated in loads would correspond to m=4 and m'=2 in FIG. 13. A single-mode omni-beam can be obtained in FIG. 12 when one of the hybrid networks is a 1×1 network, i.e., a single connection. Thus, for example, the embodiments of FIG. 7 can be obtained using one 8×8 hybrid network and one 1×1 hybrid network, with one output of one of the 8×8 hybrid networks terminated in a load. Referring now to FIG. 7A (and again assuming N=8), one example of an arrangement of this general type can be obtained using a 7×7 hybrid network and a 1×1 hybrid network, with each hybrid network output coupled to a respective input of the mode generator.

Although the exemplary antenna feed network structures 700 (FIG. 7), 700A (FIG. 7A), 1100 (FIG. 11) and 1200 (FIG. 12) have been described above in terms of downlink transmission operation, it will be apparent to workers in the art that, by reciprocity, these structures also operate equally well in the uplink, receive direction.

FIG. 14 diagrammatically illustrates further exemplary embodiments of an antenna apparatus according to the invention. The arrangement of FIG. 14 includes both uplink (receive) chains and downlink (transmit) chains. The arrangement of FIG. 14 implements mode diversity using more uplink chains than downlink chains. The duplex filters DX of FIG. 14 arc conventional components which permit simultaneous transmission and reception of signals (the received and transmitted signals are in different frequency bands). Each of the downlink signals on the transmit chains will be directed by the corresponding duplex filter toward the antenna, and no transmit power "leaks" into the receive chain that utilizes the same duplex filter. Similarly, the uplink signals received from the antenna will be directed toward the receive chains only, with no "leakage" into the corresponding transmit chains.

Although duplex filters are not explicitly shown in the embodiments of FIGS. 7, 7A, 11 and 12, nevertheless duplex filters can be readily used to implement duplex communication capability in those embodiments. Taking FIG. 7 as an example, duplex filters could be placed at the ports 735 of the hybrid network 730. One advantage of this arrangement would be that, assuming that the beam ports 735 are fed with uncorrelated signals, the duplex filters would not need to be phase-matched because the relative phase values of the uncorrelated signals would not matter. As another example, duplex filters could be placed at 115 between the array antenna 110 and the Butler matrix 120. This would mean that the uplink signals would correspond to antenna patterns for individual array columns, rather than the antenna patterns produced by the combination of 120, 140 and 730. In this type of arrangement, the phase performance of the duplex filters should be considered, because a signal corresponding to a particular beam port 735 will (typically) be transmitted through more than one of the connections at 115.

As a further example, the duplex filters could be placed between the two Butler matrices 120 and 730 of FIG. 7. In such an arrangement, the phase performance of the duplex filters would matter for the same reasons given above.

Figure 9:
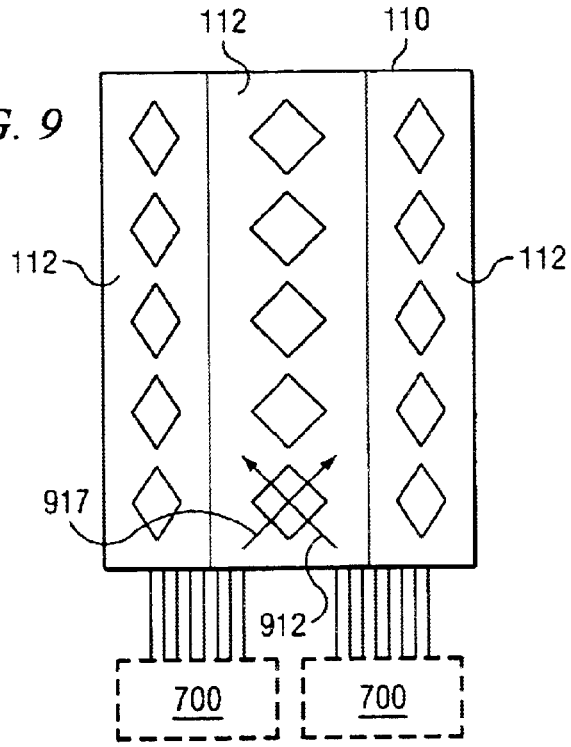
FIG. 9 diagrammatically illustrates an exemplary embodiment of dual-polarized antenna in accordance with the present invention.

The generation of simultaneous pencil- and omni-beams using a single circular array aperture in this manner can also be applied using different numbers of elements or with more than one omnidirectional beam. For greater values of N (and thus larger antennas), more modes can be used to create additional omnidirectional beams. It is also applicable to any array with an arbitrary number of elements for a fixed azimuthal angle (i.e., in an array column). Furthermore, it is applicable to a dual-polarized antenna. For a dual-polarized antenna, two (2) separate feed networks (e.g., 700, 700A, 1100, 1200) can be used. FIG. 9 diagrammatically illustrates an exemplary embodiment of dual-polarized rotationally symmetric antenna 110 fed by two (2) beam forming networks. Antenna 110 can be thought of as two (2) single-polarized antennas sharing a common aperture. Therefore, the above-described feed arrangements for a single-polarized antenna can be used. Each network handles only one polarization. For example, one network can handle +45 degrees, while the other network can handle −45 degrees. In this case, the polarization directions for each single element of any element column 112 are shown by arrows 912 and 917, representing +45 degrees and −45 degrees, respectively. By adding linearly increasing phase values (e.g., from left to right) to phase shifters of the feed network that handles the second polarization, a multi-beam radiation pattern with its beams interleaved with the beams of the first polarization can be achieved. At least one of the networks can be provided with duplex filters to support both uplink and downlink, and both polarizations can be used for diversity reception on uplink.

Figure 10:
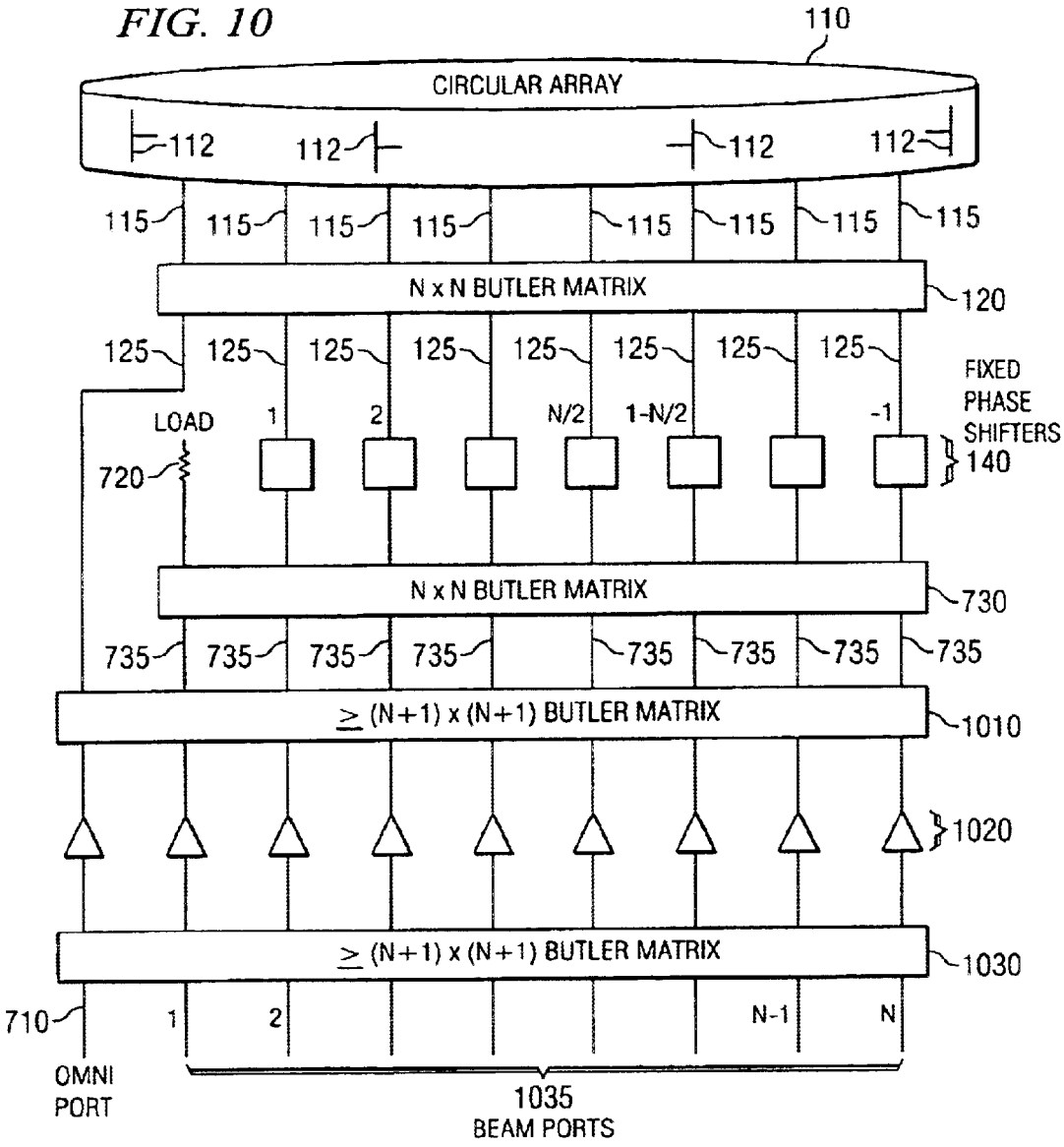
FIG. 10 diagrammatically illustrates an exemplary embodiment of a Butler matrix-fed circular array antenna with load-balancing in accordance with the present invention.

Load-balancing for the pencil-beams can be achieved by adding power amplifiers on each mode port, for example between fixed phase shifters 140 and Butler matrix 120 of FIG. 7. However, signals to be transmitted omnidirectionally must be amplified separately. Therefore, the addition of a power amplifier array, such as that shown in the embodiment illustrated in FIG. 10, can achieve load-balancing for both the pencil- and omnidirectional beams. To achieve simultaneous amplification of N pencil-beams and one (1) omni-beam, the dimensions of hybrid networks 1010 and 1030 must be at least (N+1)×(N+1). Hybrid networks 1010 and 1030 (provided, e.g., as Butler matrices) could be each other's inverses and could produce uniform amplitude over the output ports given a signal at a single input port. Power amplifiers 1020 connect hybrid networks 1010 and 1030. Similar arrangements with Butler matrices at 1010 and 1030 of sizes N×N or smaller are possible if the use of less than N independent beams is acceptable. Two (2) or more of input ports 735 of Butler matrix 730 could then be fed with the same signal, thus generating two (2) or more simultaneous pencil beams. Such "special" beams would require higher output power to achieve the same coverage as the single pencil-beam.

Referring again to FIGS. 7–14, in some exemplary embodiments, two or more of the aforementioned mutually independent input beam signals are replaced by coherent signals. This can be used to generate combinations of the beams.

Although the exemplary embodiments of FIGS. 7–14 use separate matrices and separate signal adjusters, other embodiments can be realized using one or more integrated components to produce feed networks according to the invention.

It will also be evident to workers in the art that the Butler matrices and their equivalents as described above can be implemented, in various embodiments, in hardware, software or suitable combinations of hardware and software.

Although exemplary embodiments of the invention are described above in detail, this does not limit the scope of the invention, which can be practiced in a variety of embodiments.

What is claimed is:

1. A feed network apparatus for use with a rotationally symmetric array antenna having a plurality of circumferentially spaced array antenna elements, comprising:

a feed network including a plurality of inputs and a plurality of outputs, said feed network responsive to a signal received at any one of said inputs for generating a plurality of output excitations respectively at said outputs, said output excitations respectively corresponding to circumferentially spaced radial directions respectively defined by the array antenna elements of the rotationally symmetric antenna array, said output excitations having approximately uniform amplitude, and said output excitations having respectively associated phase values that exhibit an approximately linear phase progression when considered in an order corresponding to a circumferential progression through said radial directions; and a power divider having a plurality of inputs and a plurality of outputs, said power divider outputs respectively coupled to said feed network inputs, said power divider responsive to a plurality of input signals respectively received at said power divider inputs for simultaneously distributing each of a plurality of signal powers respectively associated with said power divider input signals approximately equally among said power divider outputs.

2. The apparatus of claim 1, including a plurality of signal adjusters coupled between said power divider inputs and said feed network inputs.

3. The apparatus of claim 1, wherein each of said signal powers is less than a total signal power associated with the corresponding power divider input signal.

4. The apparatus of claim 3, wherein each of said signal powers has a predetermined ratiometric relationship relative to the corresponding total signal power.

5. The apparatus of claim 4, wherein said power divider inputs are greater in number than said power divider outputs.

6. The apparatus of claim 1, wherein said feed network outputs are greater in number than said power divider outputs.

7. The apparatus of claim 6, wherein said feed network includes a further said feed network input, said further feed network input accessible independently of said power divider for receiving a further signal carrying information that is to be transmitted generally omnidirectionally from the rotationally symmetric array antenna.

8. The apparatus of claim 1, wherein said feed network includes a Butler matrix.

9. The apparatus of claim 8, wherein said power divider includes a further Butler matrix.

10. The apparatus of claim 9, including a plurality of signal adjusters coupled between said Butler matrices.

11. The apparatus of claim 10, wherein each of said signal adjusters includes one of a fixed phase shifter, a variable phase shifter, a fixed amplitude adjuster and a variable amplitude adjuster.

12. The apparatus of claim 9, wherein said further Butler matrix and said first-mentioned Butler matrix are approximately inverses of one another.

13. The apparatus of claim 1, wherein said power divider includes a Butler matrix.

14. The apparatus of claim 1, including a plurality of signal adjusters coupled between said power divider inputs and said feed network inputs, each said signal adjuster including one of a fixed phase shifter, a variable phase shifter, a fixed amplitude adjuster and a variable amplitude adjuster.

15. The apparatus of claim 1, wherein said feed network includes a further said feed network input, said further feed network input accessible independently of said power divider for receiving a further signal carrying information that is to be transmitted generally omnidirectionally from the rotationally symmetric array antenna.

16. The apparatus of claim 15, including a power amplifier array for producing said power divider input signals and said further signal.

17. The apparatus of claim 16, wherein said power amplifier array includes first and second hybrid networks and a plurality of power amplifiers connected therebetween.

18. The apparatus of claim 17, wherein said hybrid networks respectively include Butler matrices.

19. The apparatus of claim 18, wherein said Butler matrices are approximately inverses of one another.

20. The apparatus of claim 1, wherein said feed network outputs are for connection to respective ones of the array antenna elements.

21. The apparatus of claim 1, wherein said power divider inputs are for connection to respective ones of the array antenna elements.

22. The apparatus of claim 1, wherein said feed network includes a group of further said feed network inputs, and including a further said power divider having said outputs thereof respectively coupled to said further feed network inputs.

23. The apparatus of claim 22, wherein said inputs of one of said power dividers are greater in number than said outputs thereof.

24. The apparatus of claim 22, wherein said feed network outputs are greater in number than a total of said outputs of said power divider and said outputs of said further power divider.

25. The apparatus of claim 1, wherein said power divider includes a group of further said power divider outputs, and including a further said feed network having said inputs thereof respectively coupled to said further power divider outputs.

26. The apparatus of claim 25, wherein said outputs of one of said feed networks are greater in number than said inputs thereof.

27. The apparatus of claim 25, wherein said power divider inputs are greater in number than a total of said inputs of said feed network and said inputs of said further feed network.

28. The apparatus of claim 1, wherein said power divider inputs are equal in number to said power divider outputs, and wherein said feed network outputs are greater in number than said power divider outputs.

29. The apparatus of claim 1, wherein said feed network inputs are equal in number to said feed network outputs, and wherein said power divider inputs are greater in number than said feed network inputs.

30. An antenna apparatus, comprising:

a rotationally symmetric array antenna including a plurality of circumferentially spaced array antenna elements;

a feed network including a plurality of inputs and a plurality of outputs, said feed network responsive to a signal received at any one of said inputs for generating a plurality of excitations respectively at said outputs, said excitations respectively corresponding to circumferentially spaced radial directions respectively defined by the array antenna elements of the rotationally symmetric antenna array, said output excitations having approximately uniform amplitude, and said output excitations having respectively associated phase values that exhibit an approximately linear phase progression when considered in an order corresponding to a circumferential progression through said radial directions; and a power divider having a plurality of inputs and a plurality of outputs, said power divider outputs respectively coupled to said feed network inputs, said power divider responsive to a plurality of input signals respectively received at said power divider inputs for simultaneously distributing each of a plurality of signal powers respectively associated with said power divider input signals approximately equally among said power divider outputs; and wherein one of (a) said feed network outputs and (b) said power divider inputs are respectively connected to said array antenna elements.

31. The apparatus of claim 30, wherein each of said array antenna elements includes a plurality of antenna elements.

32. The apparatus of claim 31, wherein said antenna elements of each of said array antenna elements are oriented in the corresponding said radial direction.

33. The apparatus of claim 30, wherein said array antenna is a circular-cylindric array antenna.

34. The apparatus of claim 30, wherein said feed network outputs are greater in number than said power divider outputs.

35. The apparatus of claim 34, wherein said feed network outputs are respectively connected to said array antenna elements, said feed network including a further said feed network input, said further feed network input accessible independently of said power divider for receiving a further signal carrying information that is to be transmitted generally omnidirectionally from the rotationally symmetric array antenna.

36. The apparatus of claim 30, wherein said feed network includes a Butler matrix.

37. The apparatus of claim 36, wherein said power divider includes a further Butler matrix.

38. The apparatus of claim 30, wherein said power divider includes a Butler matrix.

39. The apparatus of claim 30, including a plurality of signal adjusters coupled between said power divider inputs and said antenna feed network inputs.

40. The apparatus of claim 30, wherein said array antenna is a dual-polarized rotationally symmetric array antenna, and including a further said feed network and a further said power divider, said outputs of said further power divider respectively coupled to said inputs of said further feed network, and wherein one of (a) said outputs of said further feed network and (b) said inputs of said further power divider are connected to said dual-polarized rotationally symmetric array antenna.

41. A method of operating a rotationally symmetric array antenna having a plurality of circumferentially spaced array antenna elements, comprising:

exciting the array antenna elements to produce a plurality of approximately identical, fixed pencil-beams; and exciting the array antenna elements to produce an omnidirectional beam simultaneously with said pencil-beams.

42. The method of claim 41, wherein said first-mentioned exciting step includes, for each pencil-beam, exciting a plurality of the array antenna elements to produce said pencil-beam.

43. The method of claim 41, wherein said last-mentioned exciting step includes exciting the array antenna elements with a Butler matrix, and individually accessing a mode generated by the Butler matrix.

44. The method of claim 43, wherein said first-mentioned exciting step includes exciting the array antenna elements with the Butler matrix to produce N of said pencil-beams, and driving only less than N inputs of the Butler matrix.

45. The method of claim 41, wherein said first-mentioned exciting step includes exciting the array antenna elements with a Butler matrix to produce N of said pencil-beams, and driving only less than N inputs of the Butler matrix.

* * * * *